US007708049B2

(12) United States Patent
Bohmann et al.

(10) Patent No.: US 7,708,049 B2
(45) Date of Patent: May 4, 2010

(54) SHEET DOOR SYSTEM WITH TRANSITION WHEELS

(75) Inventors: Chris M. Bohmann, Bethlehem, GA (US); Willie Frank Ellis, Colbert, GA (US); Mark DeWolfe, Bogart, GA (US)

(73) Assignee: Overhead Door Corporation, Lewisville, TX (US)

( * ) Notice: Subject to any disclaimer, the term of this patent is extended or adjusted under 35 U.S.C. 154(b) by 146 days.

(21) Appl. No.: 11/824,893

(22) Filed: Jul. 3, 2007

(65) Prior Publication Data

US 2009/0008043 A1 Jan. 8, 2009

(51) Int. Cl.
*E05F 15/00* (2006.01)

(52) U.S. Cl. ..... 160/201; 160/133; 160/214

(58) Field of Classification Search ..... 160/201, 160/133, 191, 192, 214
See application file for complete search history.

(56) References Cited

U.S. PATENT DOCUMENTS

| | | | | |
|---|---|---|---|---|
| 3,349,516 | A | | 10/1967 | Armstrong |
| 4,013,113 | A | | 3/1977 | Frei |
| 4,966,219 | A | | 10/1990 | Sonolet |
| 4,986,331 | A | * | 1/1991 | Henkenjohann ..... 160/201 |
| 5,042,556 | A | * | 8/1991 | Ruiter ..... 160/201 |
| 5,135,040 | A | * | 8/1992 | Ruiter ..... 160/201 |
| 5,172,742 | A | | 12/1992 | Iwasaki et al. |
| 6,041,843 | A | | 3/2000 | Mullet |
| 6,257,305 | B1 | | 7/2001 | Mullet et al. |
| 6,698,490 | B2 | | 3/2004 | Hoerner et al. |
| 6,752,476 | B2 | | 6/2004 | Lin |
| 6,942,000 | B2 | | 9/2005 | Hoerner et al. |
| 6,955,206 | B2 | | 10/2005 | Mullet et al. |
| 7,028,741 | B2 | | 4/2006 | Coenraets |
| 2006/0086468 | A1 | | 4/2006 | Altimore |

* cited by examiner

*Primary Examiner*—Blair M. Johnson
(74) *Attorney, Agent, or Firm*—Gardere Wynne Sewell LLP; Kenneth R. Glaser

(57) ABSTRACT

A door system includes a flexible corrugated closure member guided between door open and closed positions in spaced apart opposed vertical and horizontal sets of guide tracks and further guided by transition guide wheels mounted on an enclosure frame for guiding the closure member between the sets of guide tracks. The transition guide wheels are supported for movement between working and non-working positions to facilitate storage or shipping the door system or an enclosure unit including the door system, as a substantially planar stack of wall, ceiling and floor members forming the enclosure.

20 Claims, 4 Drawing Sheets

SHEET DOOR SYSTEM WITH TRANSITION WHEELS

BACKGROUND OF THE INVENTION

In the art of upward acting doors and flexible closure member or so called rollup type doors, a conventional construction comprises a door which is rolled onto and off of a rotatable drum to provide for moving the door between open and closed positions. In certain applications of rollup doors and, in particular, so called sheet doors, it may be desirable to mount the door and/or ship the door wherein the door rolled onto a drum would be disadvantageous. In low headroom door applications or applications wherein the enclosure or structure using the door is collapsible, a door which is adapted for rolling onto and off of a cylindrical drum would occupy too much space. Accordingly, there has been a need for a flexible type door, or so called sheet door, which may be stored in a generally planar or unrolled condition and moved between open and closed positions without requiring a storage drum or a continuous guide track between a vertical or closed position of the door and a horizontal or open position of the door, for example. It is to these ends that the present invention has been developed.

SUMMARY OF THE INVENTION

The present invention provides an improved door system, including a flexible door closure member, sometimes referred to in the art as a sheet door.

The present invention also provides an improved upward acting door which is moved between open and closed positions on spaced apart guide tracks which include generally linear vertically extending tracks and generally linear horizontally extending tracks and spaced apart transition members are provided which engage the door closure member for guiding the closure member between door open and closed positions.

In accordance with one aspect of the present invention an improved upward acting flexible door, or so called sheet door, is provided which is adapted for use with enclosures which have low headroom or enclosures which may be of a type which may be disassembled and collapsed into a stack of substantially flat planar wall, ceiling and floor sections, for example. The improved door system is provided with a flexible sheet-like closure member having parallel undulations or corrugations configured not unlike relatively wide gear teeth and which are engageable with a pair of spaced apart rotatable transition guide wheels which guide the door between generally vertically extending guide tracks and generally horizontally extending guide tracks, respectively.

In accordance with another aspect of the invention, a door system is provided for an enclosure wherein spaced apart closure member transition guide wheels are suitably mounted on opposed frame members of the enclosure, which frame members may be disposed in a substantially flat compact stack to provide for more efficient and less space occupying shipping or storage operations. The sheet door system of the present invention is particularly adapted for portable enclosures which may be shipped in a collapsed and generally flat stack of sidewalls, ceiling and floor members, for example. The door system of the invention also provides an advantageous arrangement of a counterbalance shaft and cable drum mechanism for the door closure member.

Those skilled in the art will recognize the above-identified advantages and superior features of the invention as well as other important aspects thereof upon reading the detailed description which follows in conjunction with the drawings.

DETAILED DESCRIPTION OF A PREFERRED EMBODIMENT

Figure 1:
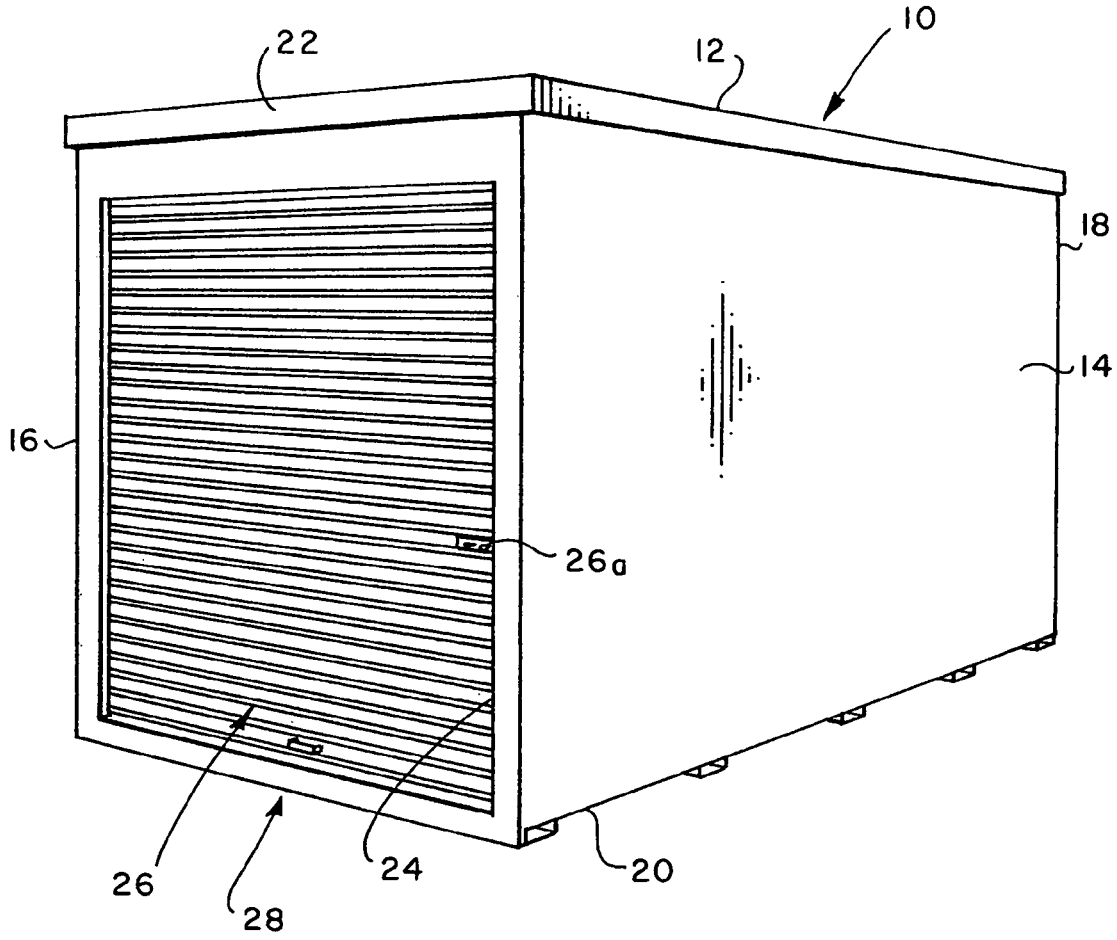
FIG. 1 is a perspective view of a generally rectangular box-like enclosure utilizing the improved sheet door system of the present invention.

In the description which follows like parts are marked throughout the specification and drawing with the same reference numerals, respectively. The drawing figures are not necessarily to scale and certain elements may be shown exaggerated in scale or in somewhat schematic form in the interest of clarity and conciseness.

Referring to FIG. 1, there is illustrated a generally rectangular box-like enclosure 10 configured as a portable storage unit having a generally flat ceiling or roof section 12, opposed sidewalls 14 and 16, a rear wall 18, a bottom wall or floor 20 and a minimal front wall 22 providing a generally rectangular opening 24. Opening 24 is closable by a door system including a flexible closure member or barrier 26, also known as a sheet door. Those skilled in the art will recognize that, although the sheet door system of the invention is particularly adapted for applications in conjunction with the portable enclosure unit 10, the sheet door system including the door closure member 26 may be used in many other applications requiring, for example, low headroom and/or storage of the door system in a relatively flat nonrolled condition. The term enclosure herein may also include garages, and similar structures requiring a closable opening suitable for a relatively flexible closure member.

Figure 2:
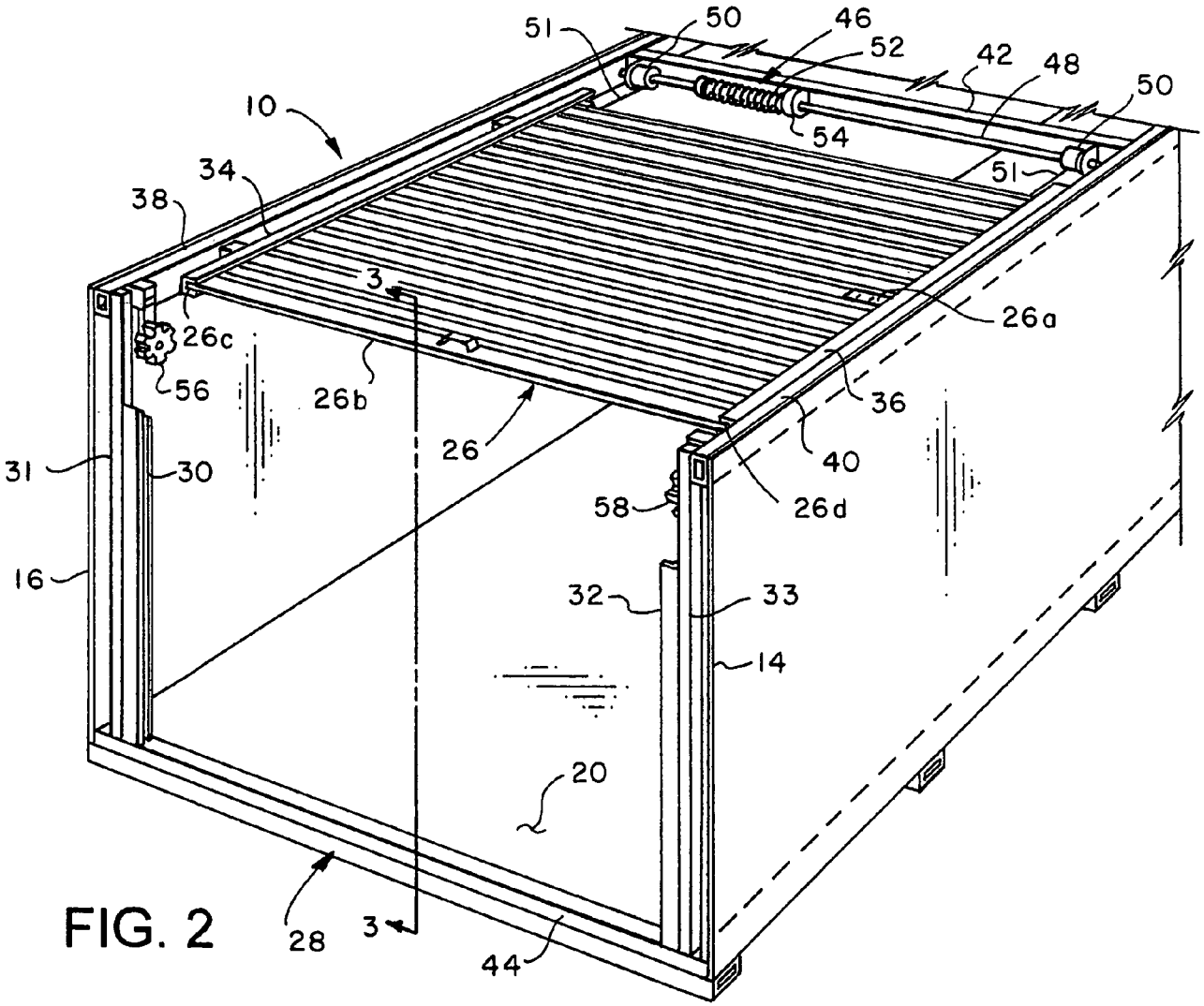
FIG. 2 is a perspective view illustrating the sheet door support structure, including the door engaging transition guide wheels.
Figure 3:
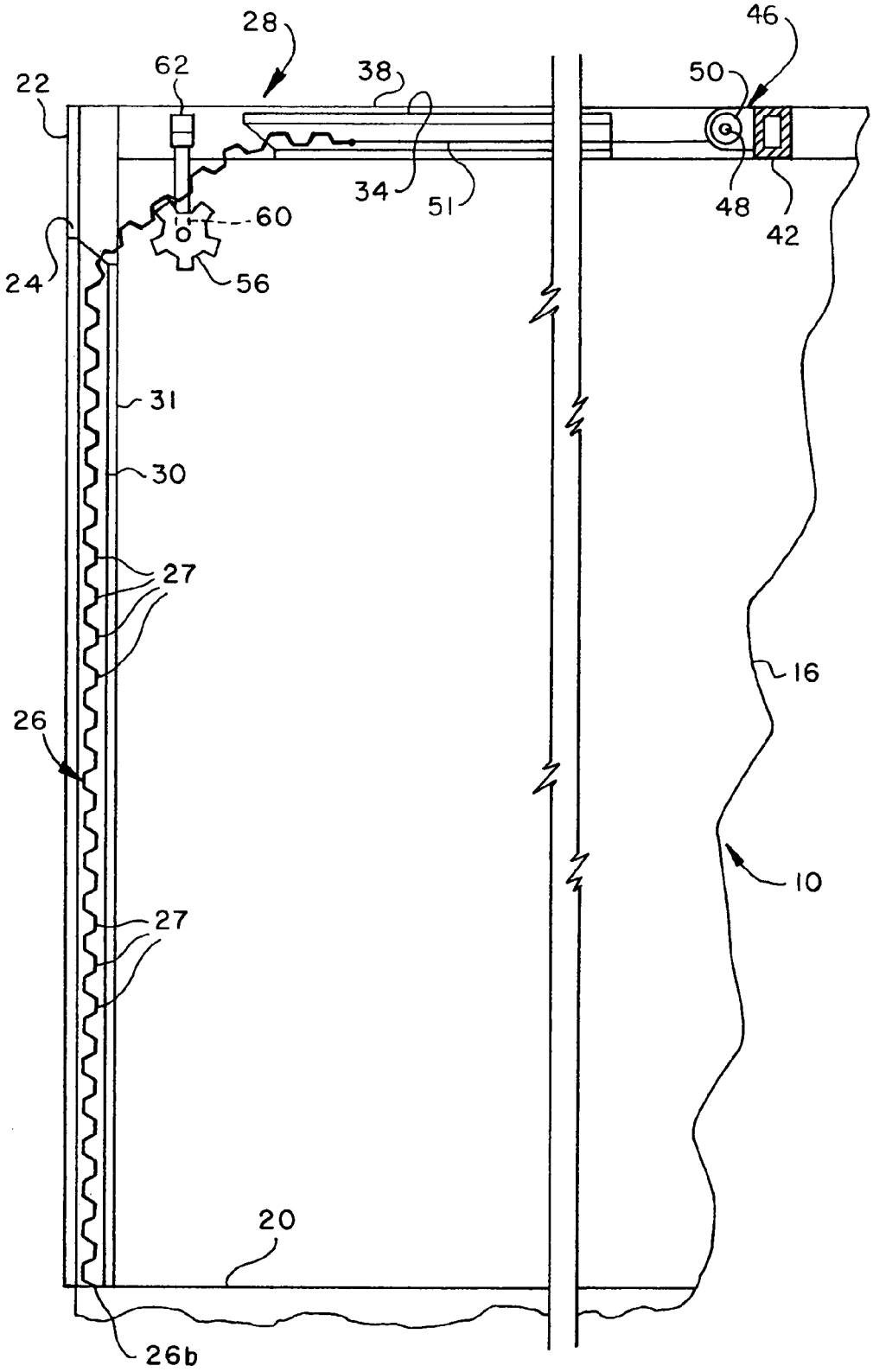
FIG. 3 is a view taken generally along the line 3-3 of FIG. 2.

Referring now to FIG. 2, and also to FIG. 3, the enclosure or storage unit 10 is illustrated with the roof or ceiling member 12 removed and the minimal front wall 22 removed to illustrate certain structural features of a door system 28 in accordance with the invention and which includes the flexible closure member or sheet door 26. Sheet door system 28 includes opposed, somewhat channel shaped, vertically extending guide tracks 30 and 32 which are mounted on respective column members 31 and 33 forming part of the sidewalls or framing for same of the enclosure 10. Spaced apart generally horizontally extending guide tracks 34 and 36 are aligned with the respective guide tracks 30 and 32 for guiding and supporting the sheet door closure member 26. Opposite side edges 26*c* and 26*d*, FIG. 2, of the sheet door closure member 26 may be slidably disposed in the channel shaped guide tracks 34 and 36 in the open position of the closure member 26, as shown in FIG. 2, which position is disposed at least at an acute angle with respect to the position or plane of the closure member in a closed position. The position of closure member 26 shown in FIG. 2 may be that suitable for storage or transport of the enclosure 10 in an assembled or disassembled and stacked condition of the enclosure floor, wall and ceiling members. When the closure member 26 is placed in use, the in use door open position may be one where side edges 26*c* and 26*d* adjacent bottom edge 26*b* remain disposed in the upper portions of guide tracks 30 and 32 to provide for maintaining alignment of the closure member with the guide tracks.

When the closure member 26 is disposed in a door closed position, as shown in FIG. 3, the opposed side edges 26*c* and 26*d* are supported in and guided by guide tracks 30 and 32, respectively. Guide tracks 34 and 36 are suitably mounted on spaced apart, essentially identical, elongated, parallel, rectangular tubular frame members or beams 38 and 40, as illustrated. At least one transverse frame member 42 interconnects frame members 38 and 40. Additional frame members, not shown, may be provided to form the structure of the enclosure 10 and frame members 38 and 40, preferably, comprise framing for ceiling or roof section 12, not otherwise shown in FIGS. 2 and 3. Moreover, frame members or beams 38 and 40 are also suitably connected to and provide support for planar wall sections 14 and 16. The column members 31 and 33 are suitably releasably or permanently joined to the frame members 38 and 40, respectively, and the column members 31 and 33 may also be suitably joined to a floor beam or similar structural member 44, also as shown in FIG. 2. Transverse frame member 42 is adapted to support a counterbalance mechanism, generally designated by the numeral 46, for counterbalancing the weight of the door closure member 26 when it is moved between an open position, as shown in FIG. 2 and a closed position as shown in FIGS. 1 and 3. Counterbalance mechanism 46 may of a type including an elongated rotatable shaft 48 suitably supported on frame member 42, spaced apart cable drums 50 suitably secured to the shaft 48 for rotation therewith, and one or more torsion counterbalance springs 52 sleeved over the shaft. Spring 52 is preferably anchored to the shaft 48 at one end of the spring and anchored to a stationary bracket member 54 mounted on the frame member 42 at an opposite of the spring. The torsion spring 52 may be pretensioned in a known way to exert a torque through the cable drums 50 to respective flexible cables 51 wound thereon and connected at their distal ends to the closure member 26, as also shown in FIGS. 2 and 3. The counterbalance mechanism 46 is advantageously mounted on beam 42 and does not project substantially above or below the beam so as to facilitate storage and shipping of the enclosure 10 in a collapsed condition.

Referring further to FIG. 3, the cross-sectional shape of the flexible closure member 26 is preferably as shown and comprises spaced apart undulations or corrugations 27 having a geometry similar in some respects to spur gear teeth. Closure member 26 may be formed of a continuous sheet of metal or plastic wherein the corrugations or undulations 27 are formed by deforming the material of the sheet closure member or by extruding the sheet closure member of a desired material. Accordingly, closure member 26 may move between the vertical guide tracks 30 and 32 and horizontal guide tracks 34 and 36 and closure member 26 is advantageously guided between such guide tracks by spaced apart transition guide wheels 56 and 58 which are supported in the positions shown in FIGS. 2 and 3 on the frame members 38 and 40.

Figure 4:
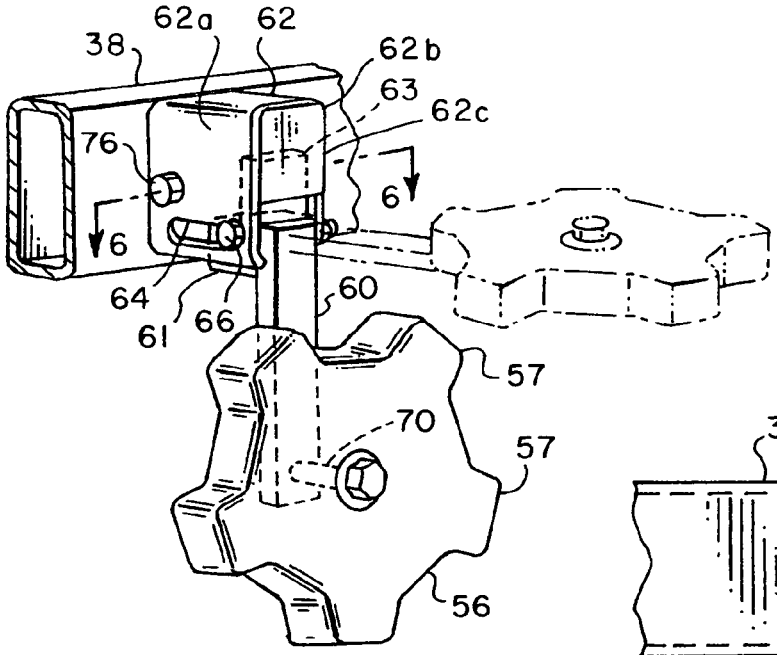
FIG. 4 is a detail perspective view of one of the transition guide wheels.
Figure 5:
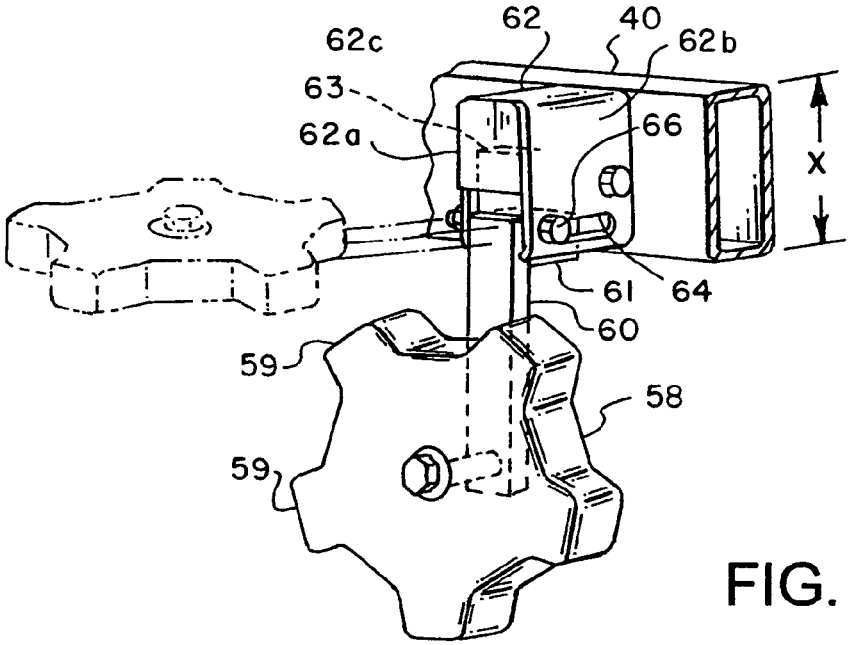
FIG. 5 is a detail perspective view of the other transition guide wheel for the sheet door system of the present invention.

As shown in FIGS. 4 and 5, guide wheels 56 and 58 may be identical and are preferably formed with circumferentially spaced radially projecting cogs or teeth 57 and 59, respectively, which cogs or teeth have a geometry essentially corresponding to the undulations or corrugations 27 of the sheet door closure member 26. In this way, the closure member 26 may be guided more precisely and positively by wheels 56 and 58 when being moved between the open position shown in FIG. 2 and the closed position shown in FIG. 3.

As further shown in FIGS. 4 and 5, each of guide wheels 56 and 58 is mounted for free rotation on an axle 70 connected to a depending support arm 60 which is mounted for pivotal movement on a support bracket 62. Each support bracket 62 comprises a somewhat inverted channel shaped member having opposed slots 64 formed in respective flanges 62*a* and 62*b* of the bracket 62, one slot shown for each bracket, through which a pivot bolt 66 may project and serve as a support shaft for the support arm 60. Support arm 60 includes a transverse leg 61 having a suitable bore 61*a* formed therein, FIG. 6, for receiving the pivot bolt 66. As further shown in FIGS. 4, 5 and 6, each support arm 60 includes an upstanding stop leg 63 engageable with an end cap 62*c* of bracket 62 to limit rotation of arm 60 to a substantially vertical position as shown in FIGS. 4 and 5. Accordingly, in the working positions shown of the respective guide wheels 56 and 58, effective guidance of the closure member 26 is provided when the closure member is moved between open and closed positions under, at least partly, the urging of the counterbalance mechanism 46. A suitable closure member latch bolt and/or handle 26*a*, FIG. 1, may be provided on the exterior side of the closure member 26 for locking the closure member in a closed position and for use as a handhold for initial, manual movement of the closure member from a closed position. The closure member 26 may also be grasped at its bottom edge 26*b* to assist in movement thereof.

Referring again to FIGS. 4 and 5, an advantage of the sheet door system 28 is the provision of the guide wheels 56 and 58 which may be moved between the working positions shown and storage or shipping positions, as indicated by the alternate positions of the wheels in FIGS. 4 and 5. Since the respective support arms 60 for the transition guide wheels 56 and 58 may be mounted for pivotal movement between the positions shown in FIGS. 4 and 5, the guide wheels may occupy space no greater, essentially, than the transverse height "x", FIG. 5, of the frame members or beams 38 and 40 when in the wheel stored positions, thereby enabling stacking of components of the enclosure 10, such as the ceiling 12, sidewalls 14 and 16, back wall 18, front wall 22 and floor 20. This is an advantage in storage and shipping of collapsible storage enclosures, such as the enclosure 10. In addition to the other advantageous features of the sheet door system 28, the transition guide wheels 56 and 58 eliminate curved transition track members between the vertical tracks 30 and 32 and horizontal tracks 34 and 36. Thus, the door system 28 may be stored and shipped in a compact, space saving configuration alone or as part of a collapsible enclosure unit, as described.

Figure 6:
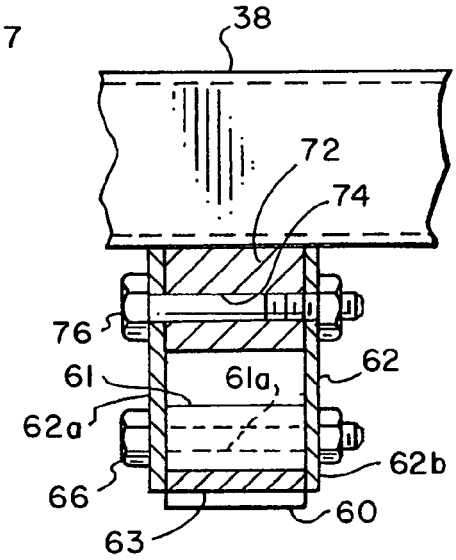
FIG. 6 is a detail section view taken generally along line 6-6 of FIG. 4.

Referring further to FIGS. 4, 5 and 6, each support bracket 62 may be permanently secured to the beams 38 and 40, such as by welding or releasably secured to the beams 38 and 40. For example, as shown in FIG. 6, in particular, a generally rectangular boss 72 may be suitably secured to beam 38, such as by welding, and have a transverse bore 74 formed therein for receiving a bolt assembly 76. Boss 72 is configured to receive an open end of channel shaped bracket 62 wherein the opposed flanges 62*a* and 62*b* are provided with fastener receiving bores which are alignable with the bore 74 and each bracket 62 fits snugly on and over a boss 72 and is secured thereto by the bolt assembly 76. Accordingly, the transition guide wheels 56 and 58, together with their respective support arms 60 and supporting bracket 62, may be releasably secured to the beams 38 and 40, if desired. Still further, the lateral positions of the wheels 56 and 58 may be adjusted by placing the support arms 60 in a desired position within the slots 64 prior to tightening the bolts 66 which secure the support arms to the support brackets 62. Accordingly, a versatile mounting arrangement for the respective guide wheels 56 and 58 is provided as described above.

The construction and operation of the sheet door system 28 is believed to be within the purview of one skilled in the art based on the foregoing description. Conventional engineering materials used for flexible upward acting doors, also known as so called sheet doors, may be used to construct the door system 28. Although a preferred embodiment has been disclosed in detail herein, those skilled in the art will also recognize that various substitutions and modifications may be made without departing from the scope and spirit of the appended claims.

What is claimed is:

1. A sheet door system for closing an opening in an enclosure, said door system comprising:

a flexible sheet closure member;

spaced apart first and second sets of guide tracks for engagement with opposed side edges of said closure member, said sets of guide tracks being arranged to support said closure member in respective open and closed positions of said closure member; and opposed transition guide wheels engaged with said closure member for guiding said closure member for movement between said open and closed positions, said guide wheels being disposed between said respective sets of guide tracks;

wherein said guide wheels are each pivotally attached to said door system such that said guide wheels may adjust from a working position engageable with said closure member to a non-working position disengaged from said closure member.

2. The door system set forth in claim 1 including:

a counterbalance mechanism connected to said closure member for at least partially counterbalancing the weight of said closure member.

3. The door system set forth in claim 2 wherein:

said counterbalance mechanism is mounted on said enclosure adjacent one end of said closure member when said closure member is in an open position.

4. The door system set forth in claim 3 wherein:

said counterbalance mechanism includes at least one flexible member connected to said closure member.

5. The door system set forth in claim 1 wherein:

said closure member includes spaced apart corrugations and said guide wheels include corresponding teeth engageable with said closure member at said corrugations for positive engagement of said closure member with said guide wheels.

6. The door system set forth in claim 1 wherein:

said guide wheels are mounted on respective support arms supported on spaced apart frame members of said enclosure.

7. The door system set forth in claim 1 wherein:

said guide wheels are each mounted for movement to a position whereby said guide wheels do not project substantially above or below opposed edges of spaced apart frame members of said enclosure, respectively.

8. The door system set forth in claim 1 wherein:

said guide wheels are mounted on respective brackets removably mounted on spaced apart frame members of said enclosure, respectively.

9. The door system set forth in claim 6 wherein:

said guide wheels are mounted on respective support arms which are mounted for limited adjustable lateral positioning of said guide wheels with respect to opposed side edges of said closure member.

10. A sheet door system for closing an opening in an enclosure, said door system comprising:

an enclosure including a frame;

a flexible sheet closure member including spaced apart corrugations formed therein;

spaced apart first and second sets of guide tracks for engagement with opposed side edges of said closure member, said sets of guide tracks being arranged to support said closure member in respective open and closed positions of said closure member; and opposed transition guide wheels supported on said frame, said guide wheels including circumferentially spaced teeth engaged with said closure member at said corrugations for guiding said closure member for movement between said open and closed positions, said guide wheels being disposed between said respective sets of guide tracks;

wherein said guide wheels are each pivotally attached to said enclosure such that said guide wheels may adjust from a working position engageable with said closure member to a non-working position disengaged from said closure member.

11. The door system set forth in claim 10 including:

a counterbalance mechanism mounted on said enclosure and disposed adjacent one end of said closure member when said closure member is in an open position, said counterbalance mechanism including at least one flexible member connected to said closure member.

12. The door system set forth in claim 10 wherein:

said guide wheels are mounted on respective support arms supported on spaced apart members of said frame.

13. The door system set forth in claim 12 wherein:

said guide wheels are each mounted for movement to a position whereby said guide wheels do not project substantially above or below opposed edges of said members, respectively.

14. The door system set forth in claim 12 wherein:

said support arms are mounted on respective support brackets removably mounted on said members of said frame.

15. A sheet door system for closing an opening in an enclosure, said door system comprising:

a frame;

a flexible sheet closure member;

spaced apart first and second sets of guide tracks for engagement with opposed side edges of said closure member, said sets of guide tracks being arranged to support said closure member in respective open and closed positions of said closure member; and opposed transition guide wheels engaged with said closure member for guiding said closure member for movement between said open and closed positions, said guide wheels being disposed between said respective sets of guide tracks;

wherein said guide wheels are each moveable from a working position engageable with said closure member to a non-working position disengaged from said closure member; and further wherein said guide wheels are each pivotally mounted for movement to a position whereby said guide wheels do not project substantially above or below opposed edges of spaced apart members of said frame, respectively.

16. A sheet door system for closing an opening in an enclosure, said door system comprising:

a flexible sheet closure member;

spaced apart first and second sets of guide tracks for engagement with opposed side edges of said closure member, said sets of guide tracks being arranged to support said closure member in respective open and closed positions of said closure member; and opposed transition guide wheels engaged with said closure member for guiding said closure member for movement between said open and closed positions, said guide wheels disposed between said respective sets of guide tracks, and said guide wheels mounted on respective support arms supported on spaced apart frame members of said enclosure;

wherein said guide wheels are each pivotable from a working position engageable with said closure member to a non-working position disengaged from said closure member; and further wherein said respective support arms are mounted for limited adjustable lateral positioning of said guide wheels with respect to opposed side edges of said closure member.

17. A sheet door system for closing an opening in an enclosure, said door system comprising:

a frame;

a flexible sheet closure member including spaced apart corrugations formed therein;

spaced apart first and second sets of guide tracks for engagement with opposed side edges of said closure member, said sets of guide tracks being arranged to support said closure member in respective open and closed positions of said closure member; and opposed transition guide wheels supported on said frame, said guide wheels including circumferentially spaced teeth engaged with said closure member at said corrugations for guiding said closure member for movement between said open and closed positions, said guide wheels being disposed between said respective sets of guide tracks, and said guide wheels mounted on respective support arms supported on spaced apart members of said frame;

wherein said guide wheels are pivotable between working positions to nonworking positions with respect to said frame; and further wherein said guide wheels are each mounted for movement to a position whereby said guide wheels do not project substantially above or below opposed edges of said frame members, respectively.

18. A sheet door system for closing an opening in an enclosure, said door system comprising:

a frame;

a flexible sheet closure member;

spaced apart first and second sets of guide tracks for engagement with opposed side edges of said closure member, said sets of guide tracks being arranged to support said closure member in respective open and closed positions of said closure member; and opposed transition guide wheels engaged with said closure member for guiding said closure member for movement between said open and closed positions, said guide wheels being disposed between said respective sets of guide tracks;

wherein said guide wheels are each pivotally mounted for movement to a position whereby said guide wheels do not project substantially above or below opposed edges of spaced apart members of said frame, respectively.

19. A sheet door system for closing an opening in an enclosure, said door system comprising:

a flexible sheet closure member;

spaced apart first and second sets of guide tracks for engagement with opposed side edges of said closure member, said sets of guide tracks being arranged to support said closure member in respective open and closed positions of said closure member; and opposed transition guide wheels engaged with said closure member for guiding said closure member for movement between said open and closed positions, said guide wheels being disposed between said respective sets of guide tracks;

wherein said guide wheels are pivotally mounted on respective support arms which are mounted for limited adjustable lateral positioning of said guide wheels with respect to opposed side edges of said closure member.

20. A sheet door system for closing an opening in an enclosure, said door system comprising:

a frame;

a flexible sheet closure member including spaced apart corrugations formed therein;

spaced apart first and second sets of guide tracks for engagement with opposed side edges of said closure member, said sets of guide tracks being arranged to support said closure member in respective open and closed positions of said closure member; and opposed transition guide wheels supported on said frame, said guide wheels including circumferentially spaced teeth engaged with said closure member at said corrugations for guiding said closure member for movement between said open and closed positions, said guide wheels being disposed between said respective sets of guide tracks, and said guide wheels are movable between working positions to nonworking positions with respect to said frame;

wherein said guide wheels are each pivotally mounted for movement to a position whereby said guide wheels do not project substantially above or below opposed edges of spaced apart members of said frame, respectively.

* * * * *